US006385921B1

(12) United States Patent
Evans

(10) Patent No.: US 6,385,921 B1
(45) Date of Patent: May 14, 2002

(54) UNDERGROUND STRUCTURE FOR RESIDENTIAL AND BUSINESS USE

(76) Inventor: James P. Evans, 503 Washington St., Cedar Falls, IA (US) 50613

( * ) Notice: Subject to any disclaimer, the term of this patent is extended or adjusted under 35 U.S.C. 154(b) by 0 days.

(21) Appl. No.: 09/681,180

(22) Filed: Feb. 12, 2001

(51) Int. Cl.[7] ..... E04H 7/00

(52) U.S. Cl. ..... 52/169.9; 52/169.6; 52/223.8; 52/222; 52/169.1

(58) Field of Search ..... 52/106, 489.1, 52/643, 169.6, 223.8, 223.11, 222

(56) References Cited

U.S. PATENT DOCUMENTS 4,336,674 A 6/1982 Weber
4,854,094 A * 8/1989 Clark ..... 52/79.1
5,353,557 A * 10/1994 Lerner et al. ..... 52/106
6,006,485 A * 12/1999 Hobbs et al. ..... 52/489.1
6,061,976 A 5/2000 Willbanks, Jr.

* cited by examiner

*Primary Examiner*—Carl D. Friedman
*Assistant Examiner*—Basil Katcheves
(74) *Attorney, Agent, or Firm*—James C. Nemmers

(57) ABSTRACT

A wall and roof structure primarily for buildings that are partly under ground. In the roof structure, sheets of steel are placed in an upward concave position supported by beams and columns with compression members positioned between the beams. In the walls, a similar arrangement is used with sheets of steel in a concave outward position supported between the columns. This provides a free span suspension design with no columns or bearing walls needed inside the basic structure.

8 Claims, 3 Drawing Sheets

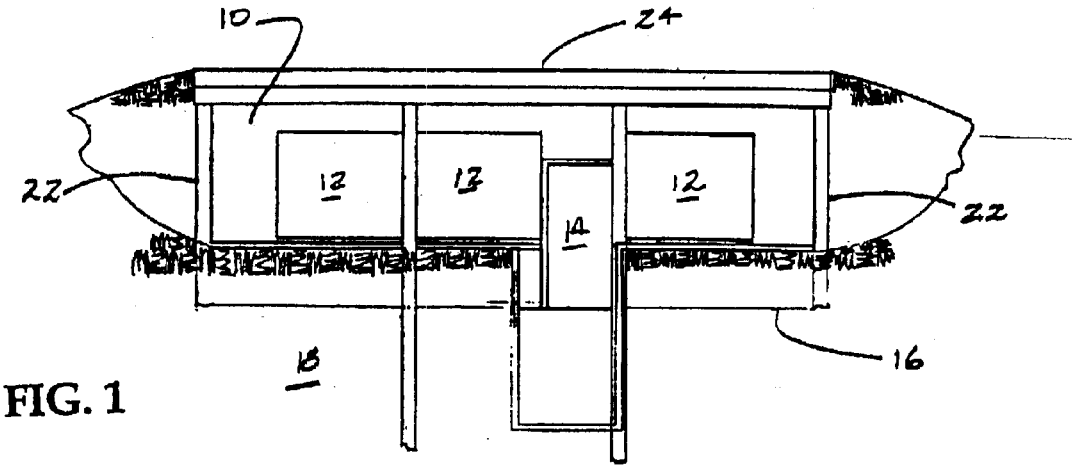
FIG. 1
FIG. 2
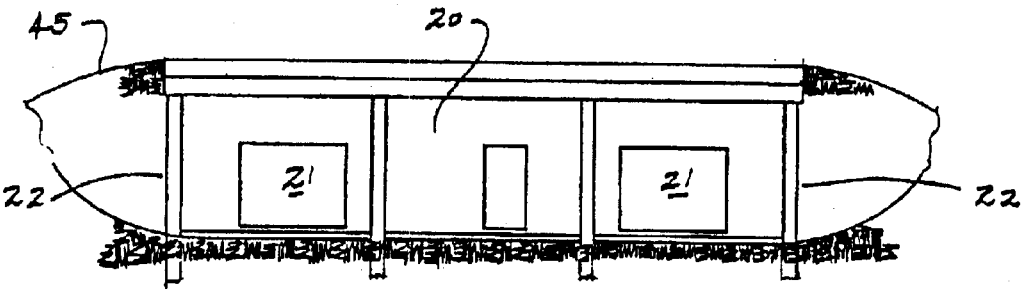
FIG. 3
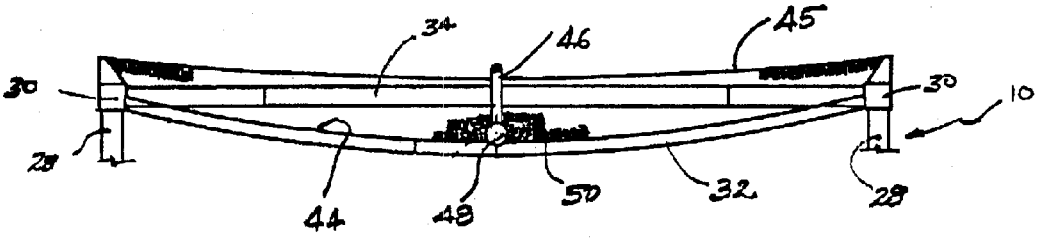

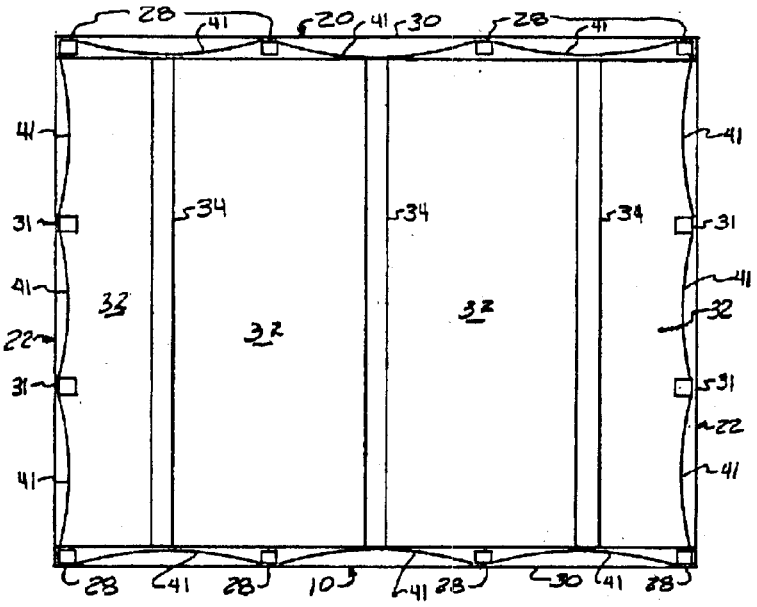
FIG. 6
FIG. 8
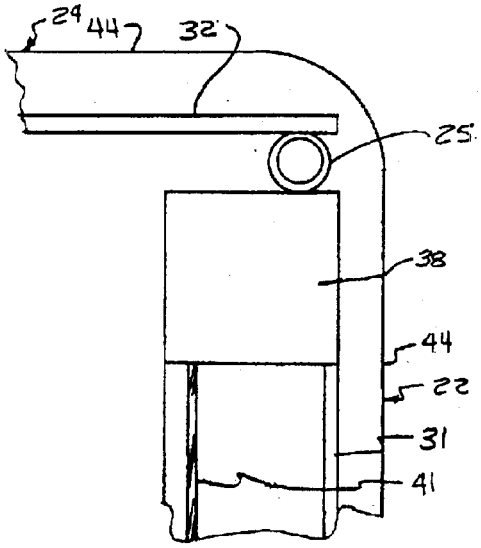
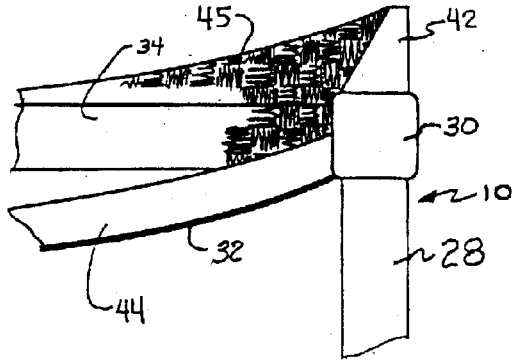
FIG. 7

UNDERGROUND STRUCTURE FOR RESIDENTIAL AND BUSINESS USE

BACKGROUND OF THE INVENTION

In order to conserve energy, builders of residential and business structures have looked increasingly to the inherent advantages of an underground structure. Such structures not only conserve energy by providing warmth in the wintertime and coolness in the summertime, but such structures minimize almost all external noise and therefore provide a nearly silent environment. Obviously, such structures provide increased protection against natural calamities, such as high wind, lightning, tornadoes, and they are more fire resistant than conventional above-ground structures. In addition, such structures are virtually maintenance free exteriorly and are impervious to termites. Further advantages of underground structures are that there is virtually no possibility of frozen water pipes with resultant damage to plumbing and plumbing fixtures, and insurance rates are markedly reduced because of the natural protection provided.

The primary reason why underground structures for both residential and business use have not become more popular is because known building techniques for such structures are too expensive. In addition to the high cost of conventional designs, there is a certain amount of reluctance to undertake building such underground structures because of a concern of collapse and deterioration under the weight of the overlying earth. Such concerns are only justified if the materials of construction are inadequate to carry the weight of the surrounding earth material, and in order to overcome these concerns, known construction techniques add considerably to the cost.

It is therefore a primary object of the invention to provide a structure that provides all of the advantages of the earth sheltered construction but which can be constructed at costs competitive with conventional above-ground structures.

SUMMARY OF THE INVENTION

The structure of the invention utilizes the principles of a suspension design for both the roof and buried walls. In the roof structure, sheets of steel are placed in an upward concave position supported by beams and columns with compression members positioned between the beams. In the walls, a similar arrangement is used with sheets of steel in a concave outward position supported between the columns. On relatively small structures, the invention provides a free span design with no columns or bearing walls inside the basic structure, and with larger buildings, multiple spans can be utilized.

BRIEF DESCRIPTION OF DRAWINGS

FIG. 1 is a front view of a one-story subterranean structure with a basement;

FIG. 2. is a rear view of the structure of FIG. 1;

FIG. 3 is an end view of the roof portion of the structure;

FIG. 6 is a top view of the structure of FIGS. 4 and 5 with portions not shown for purpose of clarity;

FIG. 7 is an enlarged side view of a portion of the structure of FIG. 5; and FIG. 8 is an enlarged end view of a portion of the structure showing the seal between a side wall and the roof structure.

DETAILED DESCRIPTION

Figure 4:
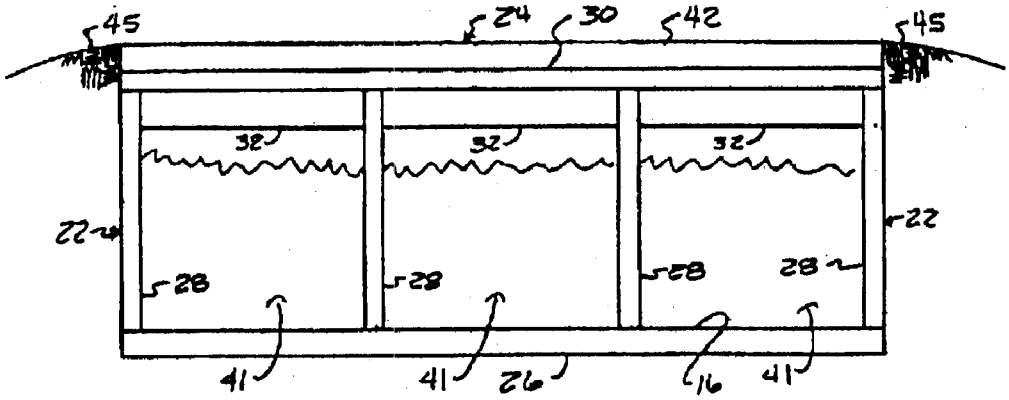
FIG. 4 is a front view of the structural components of a one-story with basement structure.

Referring first to FIGS. 1 and 2, there is illustrated a basic structure that utilizes the principles of the invention. The structure shown by way of illustration is a one-story structure. The structure includes a front wall 10 which has window openings 12 and a door opening 14. The floor line of the structure is designated by reference numeral 16 in FIG. 1. The structure of the invention includes a rear wall 20 (FIG. 2) which may have windows 21 and side walls 22 connecting the front wall 10 and rear wall 20. Except for the front wall 10 and rear wall 20, the entire structure is preferably below ground level or covered with earth 45 on the side walls 22 and the roof 24. In the preferred embodiment shown in the drawings, earth does not cover the rear wall 20 and front wall 10, but it should be understood that this is a matter of preference and that the basic structural components can be used regardless of which portions are beneath the earth or exposed.

The basic wall and roof structures will now be described. Referring now to FIGS. 3–8, the structural components only are shown and illustrated free from any interior treatment. However, it should be understood that the interior walls can be finished in any conventional manner.

The basic wall structures of the invention include footings 26 that support structureal members such as columns 28 that are spaced apart along the front wall 10 and rear wall 20. At the top of the columns 28 along the front wall 10 and the rear wall 20 are horizontally extending cap beams 30. The cap beams 30 and columns 28 provide support for the front wall 10 and rear wall 20 which support the structure of roof 24.

Figure 5:
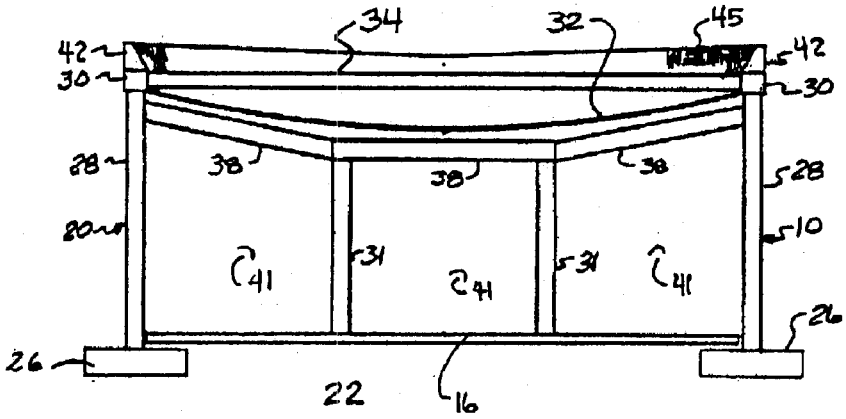
FIG. 5 is a side or end view of the structure of FIG. 4.

As best seen in FIGS. 3, 5 and 7, the structure of roof 24 is completed by suspension sheets 32 which are secured in any suitable manner at their ends to the beams 30. Suspension sheets 32 are typically made of steel sheets and are mounted upward concave since the sheets of the proper steel composition will bend or flex when supported at their ends. The steel sheets may be, for example, of 3/16 inch thick steel of any suitable composition so that when the sheets 32 are secured between the beams 30 they will have a "belly" of approximately 18 inches. The "belly" is the distance between the lowest point on the concave sheet to a plane extending across the ends of the suspension sheet 32 at the place where sheets 32 are attached to the beams 30. Obviously, the amount of belly will vary depending upon the span between beams 30 and the thickness of the steel and its composition. Preferably, compression members 34 are provided between the cap beams 30, the compression members 34 therefore extending between the rear wall 20 and the front wall 10.

To form the basic structure of side walls 22, structural members such as columns 31 are spaced apart along side walls 22 and support generally horizontally extending cap beams 38 which extend between and support the front wall 10 and rear wall 20 at a level below the cap beams 30 (see FIG. 5), the beams 38 being therefore positioned beneath the suspension sheets 32. Suitable flexible seals 25 (FIG. 8) may be provided between the cap beams 38 and suspension sheets 32. To complete the structure of side walls 22, suspension sheets 41 are secured in any suitable manner at their ends to the columns 31 and are mounted concave outward. Similarly, to complete the structure for front wall 10 and rear wall 20, suspension sheets 41 are mounted concave outward and secured in any suitable manner at their ends to the columns 28. Like suspension sheets 32, suspension sheets 41 are made of steel sheets.

It is understood that the structure shown in the preferred embodiment may also have a basement area 18 beneath the floor line 16, which basement area would contain the same basic wall structure as the first floor level above floor line 16. However, the structure shown in the preferred embodiment is a one-story structure without a basement, and FIGS. 3–8 illustrate only the basic structural elements for such a structure.

The top or plan view of FIG. 6 shows compression members 34 extending between cap beams 30. Cap beams 38 are not shown for purposes of clarity. If desired, members 34 may be split at their ends into split beams (not shown) to provide additional support between front wall 10 and rear wall 20. This arrangement would be more suitable for longer spans and would provides a cost saving since fewer compression members 34 would therefore be needed.

Referring now to FIG. 3, there is illustrated drainage for the roof 24. As illustrated, roof drains 46 are spaced apart along the roof 24, each of which drains 46 has drainage openings in it with the drain 46 leading to a drain tile 48 that runs over the top of the suspension sheet 32. The drain tile 48 extends beyond the ends of the roof 24 to carry the water out and away from the structure. Preferably, the suspension sheets 32 and 41 are covered with sprayed urethane insulation 44. Rock 50 may be placed around the drain tile 48 to facilitate maximum drainage. Kick plates 42 may also be provided at the top of beams 30 to retain the earth 45 in place on roof 24.

From the foregoing description, it is evident that the invention provides a free span design with no columns or bearing walls necessary inside the basic structure. However, on larger buildings requiring multiple spans, the outer spans will serve as an anchorage and eliminate the need for compression members 34 on the inside spans. The simplicity of the design, and thus the cost, should be evident from the description of the preferred embodiments herein. It is estimated that current earth sheltered roof and wall systems weigh approximately 100 pounds per square foot for a fifteen foot span whereas the structure of the invention weighs only 14 pounds per square foot for a 25 foot span. Typical earth shelters will cost approximately $150 per square foot because of the added structural requirements needed to support the weight of the earth. The cost per square foot of the structure of the invention is less than above-ground structures using conventional construction methods. Thus, using the principles of the invention, all of the advantages of the earth shelters can be achieved at a cost less than conventional structures. The structures of the invention also lend themselves readily to conventional interior finishing and provide for many choices of waterproofing and insulation exteriorly. It should also be understood that although the preferred embodiment is illustrated in connection with an earth sheltered structure, the basic structural concepts can be used on conventional above-ground structures for the construction of wall or roof panels which can then be assembled into a completed structure.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A structural section for an underground building useable in the construction of the building's roof or walls which are under the ground, said structural section comprising: longitudinally extending, spaced apart structural members each terminating at opposite ends; a beam extending laterally of the structural members and affixed to the members; and a curved suspension sheet having opposite ends affixed at said ends to the structural members and extending between them so that the curvature of the suspension sheet is concave upwardly.

2. The structural section of claim 1 in which the suspension sheet is made of steel.

3. The structural section of claim 2 in which the suspension sheet is steel of a uniform thickness.

4. The structural section of claim 1 in which the structural members are adapted to be supported on vertical columns, and the beam is a compression member thereby providing a roof structure.

5. A structural section for an underground building useable in the construction of the walls of a building having footings, said structural section comprising: vertically extending, spaced apart structural members each terminating at opposite ends, the structural members being adapted to be supported at one end on the footings of the building; a beam extending laterally of the structural members and affixed to the members at their ends opposite to the ends supported by the footings; and a curved suspension sheet having opposite ends affixed at said ends to the vertically extending structural members and extending between the members to form a wall structure for the building with the curvature of the suspension sheet concave upwardly.

6. The structural section of claim 5 in which the suspension sheet is made of steel.

7. The structural section of claim 6 in which the suspension sheet is steel of a uniform thickness.

8. An underground building having walls resting on footings and a roof structure supported by the walls, said building comprising: vertically extending, spaced apart columns each terminating at an upper end and a lower end, each column being adapted to be supported at its lower end on the footings of the building; a beam extending laterally of the columns and affixed to the columns at their upper ends; a first curved suspension sheet having opposite ends affixed at said ends to the adjacent columns and extending vertically between the columns to form a wall structure for the building with the curvature of the suspension sheet concave outwardly, there being four such wall structures joined together to form a rectangular-shaped building; at least one horizontally extending compression beam extending between the beams of two of the opposite wall structures; and a second curved suspension sheet having opposite ends affixed at said ends to the beams of the opposite wall structures and extending between them to form the roof structure of the building with the curvature of the suspension sheet concave upwardly.

* * * * *